United States Patent [19]

Focke et al.

[11] Patent Number: 4,592,374

[45] Date of Patent: Jun. 3, 1986

[54] PROCESS AND APPARATUS FOR FORMING GROUPS OF CIGARETTES

[75] Inventors: Heinz Focke; Kurt Liedtke, both of Verden, Fed. Rep. of Germany

[73] Assignee: Focke & Co., Verden, Fed. Rep. of Germany

[21] Appl. No.: 379,197

[22] Filed: May 17, 1982

[30] Foreign Application Priority Data

May 23, 1981 [DE] Fed. Rep. of Germany ..... 3120674

[51] Int. Cl.[4] ..... A24C 5/35

[52] U.S. Cl. ..... 131/282; 131/283; 198/478.1; 198/482.1

[58] Field of Search ..... 131/94, 282, 283; 198/478.1, 482.1

[56] References Cited

U.S. PATENT DOCUMENTS 4,368,742 1/1983 Wahle et al. ..... 131/282

FOREIGN PATENT DOCUMENTS 966649 8/1957 Fed. Rep. of Germany .
1130750 5/1962 Fed. Rep. of Germany .
1293672 10/1969 Fed. Rep. of Germany .
1632205 8/1970 Fed. Rep. of Germany .
1217916 12/1973 Fed. Rep. of Germany .
2243911 3/1974 Fed. Rep. of Germany .

*Primary Examiner*—V. Millin
*Attorney, Agent, or Firm*—Sughrue, Mion, Zinn, Macpeak and Seas

[57] ABSTRACT

In the case of high-performance cigarette packaging machines, to achieve high outputs and, at the same time, a careful treatment of the cigarettes it is important to maintain continuous movements as uninterrupted as possible. For this purpose, cigarettes (10) are extracted from a magazine (15) and are then conveyed in a single-layer sequence. Cigarette groups (11) are then formed from these likewise in a continuous operation, with an arrangement and number of cigarettes (10) corresponding to a cigarette pack.

5 Claims, 9 Drawing Figures

Fig. 4
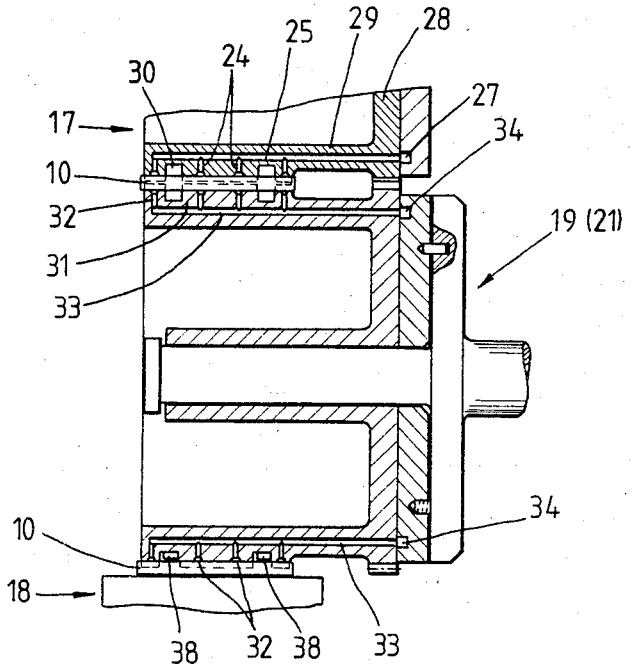
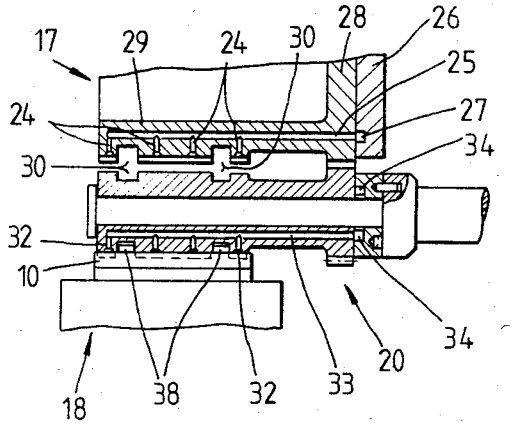
Fig. 5

PROCESS AND APPARATUS FOR FORMING GROUPS OF CIGARETTES

FIELD OF THE INVENTION

The invention relates to a process for forming groups of several rows of bar-shaped articles, especially cigarettes, which are supplied close to one another in a continuous sequence. The invention also relates to an apparatus for especially forming groups of cigarettes.

BACKGROUND OF THE INVENTION

In the packaging of cigarettes, cigarette groups each assigned to a pack are conventionally first composed of several rows formed in a specific way. In a particularly popular pack design, the two outer rows each consist of seven cigarettes and an inner or middle row located between them consists of six cigarettes. These are disposed offset, namely in a "saddle arrangement", relative to the cigarettes of the outer rows.

The formation of the cigarette groups assigned to a pack presents special technical difficulties when, on the one hand, the cigarettes are to be treated carefully in the requisite manner, but, on the other hand, in view of the high productivity of packaging machines the cigarette groups are to be formed within short cycle times. The invention is concerned with this subject in the widest sense.

The object on which the invention is based is to speed up by means of process-related and apparatus-related measures the production of cigarette groups during the packaging thereof, while also guaranteeing careful treatment of the cigarettes.

To achieve this object, the process according to the invention is characterised in that rows of cigarettes, each corresponding to a row of the cigarette group, are extracted successively in space and time in the direction of movement of the continuous sequence supplied, and after intermediate arrangement are joined together to form a group by being deposited successively in time.

The process according to the invention permits, above all, continuous progress of the working steps, so that the devices and units participating can be driven predominantly continuously. This results fundamentally in a considerable increase in performance without damage to the cigarettes.

SUMMARY OF THE INVENTION

The apparatus according to the invention for forming groups of cigarettes by applying the process mentioned above is equipped with an endless conveyor by means of which cigarettes can be supplied in a single layer close to one another. Cigarettes corresponding to the number of a row within the cigarette group are received from the endless conveyor by a row conveyor and are supplied to a group conveyor, and the rows of cigarettes are transported on the row conveyor at a distance from one another and can be transferred in succession to the group conveyor to form a group.

The conveyors mentioned above are turrets or drums preferably driven continuously, against the outer region of which the cigarettes rest periodically, specifically either on a smooth-surfaced drum casing or in suitable recesses or in pockets for receiving a row or a cigarette group respectively.

According to a preferred exemplary embodiment of the invention, the cigarettes are transferred in a single layer, in lots consisting of several cigarettes located next to one another, onto the drum casing of a collecting drum in such a way that a layer of cigarettes resting more or less closely against one another is formed on the drum. While essentially maintaining the predetermined relative positions, this collecting drum transfers the cigarettes to a row drum, on the outer periphery of which the cigarettes are positioned exactly in suitable individual recesses. From this row drum cigarettes are removed successively or at different points by transfer drums, specifically, in each case, a row corresponding to the group to be formed. After intermediate transport, this row is transferred to the group drum, specifically in such a way that the rows are introduced successively and at different points, by preferably several, especially three transfer drums, into one and the same pocket of the pocket turret moving in corresponding synchronism. All the devices thus far described and participating in the formation of the cigarette groups can advantageously be moved continuously.

The cigarettes are supplied to the collecting drum as a result of extraction from a cigarette magazine designed in a special way. According to the invention, this feeding operation takes place periodically, with the collecting drum preferably rotating continuously, when (single-layer) batches of cigarettes are extracted successively from the bottom of the cigarette magazine and are deposited on the drum casing of the collecting drum. For this purpose, there are according to the invention special transfer members which receive the particular cigarette batch periodically.

Further features of the invention relate to the design of the cigarette magazine and that of the conveying and transfer devices participating.

BRIEF DESCRIPTION OF THE DRAWINGS

Exemplary embodiments of the invention are explained in more detail below with reference to the drawings in which:

FIG. 4 shows a radial section through a detail of the apparatus in the region of the group formation, on an enlarged scale, FIG. 5 shows a representation of another detail corresponding to FIG. 4.

DESCRIPTION OF THE PREFERRED EMBODIMENTS

Figure 1:
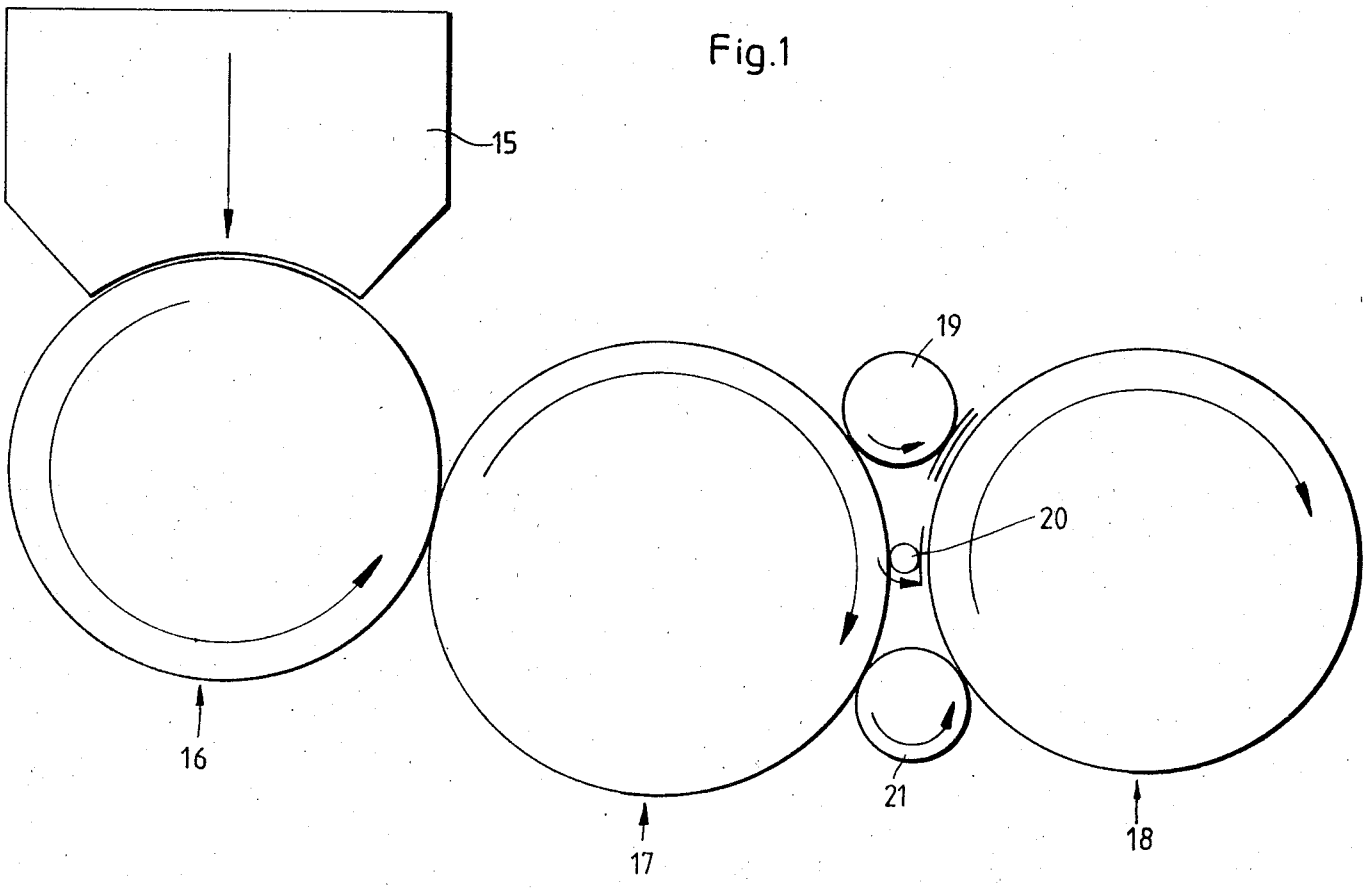
FIG. 1 shows a greatly simplified side view of the apparatus as a whole.
Figure 2:
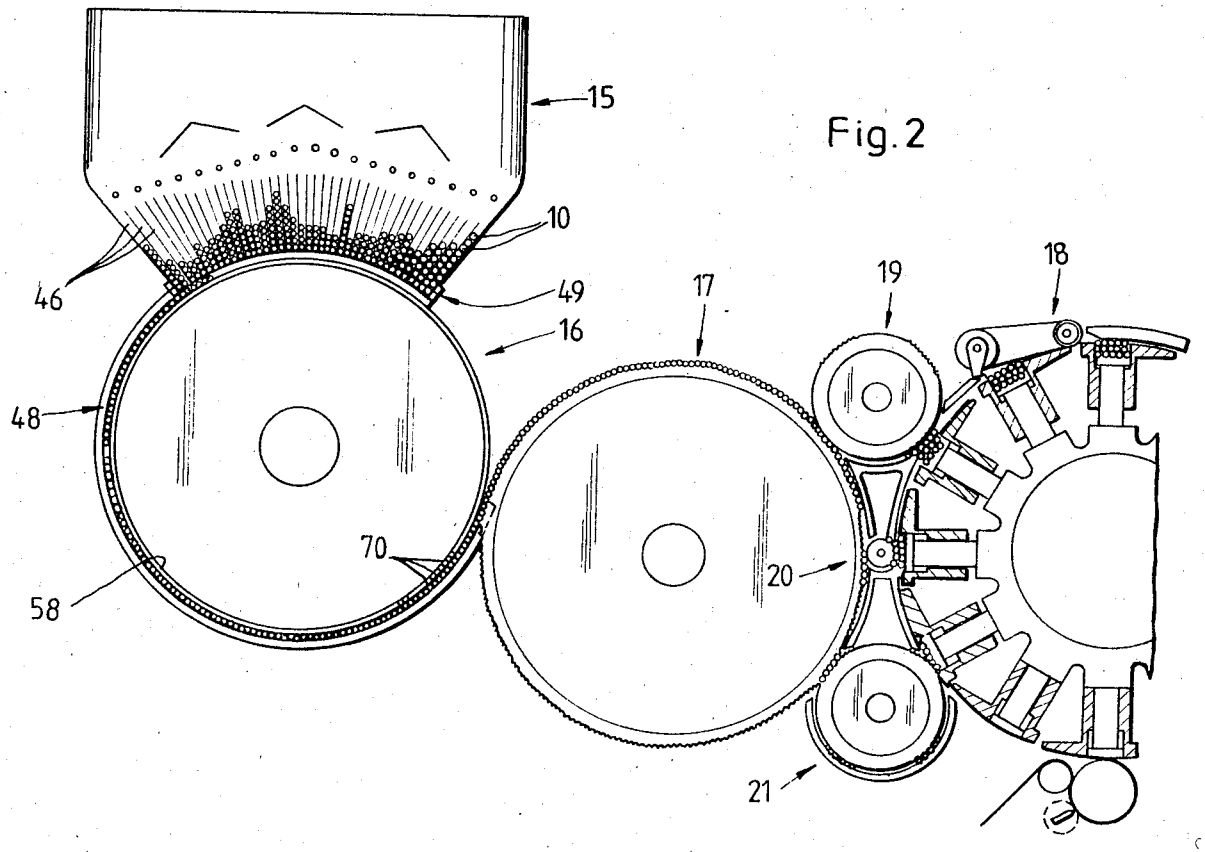
FIG. 2 shows, partially in section, a likewise simplified representation of the apparatus in a side view with details.

The exemplary embodiments illustrated in the drawings relate to the processing of cigarettes 10. The aim is to form cigarette groups 11 which correspond to the content of a cigarette pack as regards the number of cigarettes 10 and as regards their formation. In the preferred exemplary embodiment illustrated, cigarette groups 11 consisting of three cigarette rows 12, 13, 14 are formed. The two outer cigarette rows 12 and 14 each comprise seven cigarettes 10 and the middle cigarette row 13 comprises six cigarettes, the latter being shifted into a "saddle arrangement", offset relative to those of the outer cigarette rows 12, 14.

Consequently, the process described and the apparatuses illustrated are part of a more comprehensive cigarette packaging machine.

The diagrammatic construction of a first preferred embodiment of the invention emerges from FIG. 1. Coming from the cigarette-making machine, the cigarettes 10 are accommodated in a relatively large container in the form of a cigarette magazine 15. From the latter, batches are transferred to a first cigarette conveyor, namely a collecting drum 16. The cigarettes 10 conveyed in a single layer on the outer periphery of the collecting drum 16 then pass, after transport along a part of a circular arc, onto a further conveyor, namely a row drum 17. From this drum, the cigarettes 10 are transferred in rows, namely corresponding to the cigarette rows 12, 13, 14, to a conveyor receiving and transporting the cigarette groups 11, namely to a group drum 18. The drum conveyors 16, 17 and 18 are driven preferably continuously. The movements are coordinated with one another, so that the transfer of cigarettes 10 or cigarette rows 12, 13, 14 respectively from one conveyor to the other is fixed in time and place.

The formation or determination of cigarette rows 12, 13 and 14 and the transfer of these to the group drum 18 so as to form respectively the cigarette groups 11 are not carried out directly by the row drum 17, but with transfer drums 19, 20 and 21 of small diameter being interposed. The above-mentioned transfer members are arranged in the region of a short distance between the row drum 17 and the group drum 18 and are brought into positions relative to these in such a way that a cigarette row 12, 13, 14 or respectively a number of cigarettes 10 corresponding to a row is removed from the row drum 17 by each transfer drum 19, 20, 21 and, after being conveyed over a part circle, is transferred to the group drum 18. This transfer takes place in such a way that the individual cigarette rows 12, 13, 14 are deposited on the group drum 18 at a predetermined point thereon, namely in pockets **22*a*, 22*b*, 22*c*, etc. In the exemplary embodiment illustrated, a first inner cigarette row 12 in the pocket 22*a* is supplied by the transfer drum 21, a second middle cigarette row 13 is supplied by the transfer drum 20 and a third outer cigarette row 14 is supplied by the transfer drum 19 to the pockets 22*a*, 22*b*, 22*c*. The arrangement is such, here, that all three transfer drums 19, 20, 21 each transfer approximately simultaneously one of the assigned cigarette rows 12, 13, 14 into a pocket 22*a*, 22*b*, 22*c* held in an appropriately adjacent position, so that with each work cycle one cigarette group 11** is completed and, at the same time, another is partially formed.

The formation of the cigarette groups 11 is a special province of the apparatus. The row drum 17 serves as a feed-conveyor member for the cigarettes 10 arranged in a single layer and in close sequence and is provided, along the entire outer periphery, with retaining recesses 23 which are located immediately next to one another and are directed parallel to its axis and which each receive a cigarette. The above-mentioned retaining recesses 23 have a cross-section matching the dimension of a cigarette 10, but somewhat less than a semicircle.

The cigarettes 10 are fixed in the retaining recesses 23 by means of suction bores 24. These are in turn connected to connecting bores 25 (FIGS. 4 and 5) which are made parallel to the axis and which themselves connect with an annular groove 27 formed in a fixed control disc 26. In the exemplary embodiment shown (FIG. 3), every two retaining recesses 23 are connected to a common connecting bore 25 by means of their suction bores 24 arranged distributed in the longitudinal direction.

As is evident from FIGS. 4 and 5, the row drum 17 consists of a drum disc 28 arranged on one side and extending in a radial plane, and of a radially outer drum ring 29. The latter forms the retaining recesses 23 on the outer side, and these are sub-divided into individual portions by depressions or grooves 30 extending in a peripheral direction. The grooves 30 permit, at the same time, the insertion of devices for possibly guiding and lifting out the cigarettes 10 from the particular retaining recesses 23.

The transfer drums 19, 20, 21 are, in principle, designed in a similar way to that described above. The cigarettes 10 are accommodated respectively in retaining recesses 31 with a suitable cross-section, but distinctly smaller than a semicircle. To each retaining recess 31 is assigned a radially directed suction bore 32, to which an axis-parallel connecting bore 33 is assigned. These connecting bores, in turn, connect (periodically) with an annular groove 34.

The special feature of the design of the transfer drums 19, 20, 21 is that the cigarettes 10 can be received and transported only in individual, predetermined and delimited regions. In the case of the transfer drums 19 and 21 responsible for the outer cigarette rows 12 and 14, four groups of recesses **35*a*, 35*b* arranged at equal distances from one another in the peripheral direction are formed in each case. These each consist of a number of retaining recesses 31 corresponding to the number of cigarettes 10 to be received. Here, the transfer drum 20 of very small diameter has only one group of recesses 36 which consists here of six retaining recesses 31** for the reasons explained.

The transfer drums 19, 20, 21 are arranged in a special relative position both in respect of the row drum 17 and in respect of the group drum 18. The transfer drum 20 is located in the region of the shortest (peripheral) distance between the row drum 17 and the group drum 18. The transfer drums 19 and 21 are arranged offset laterally or respectively downwards and upwards relative to one another at the same distances. In all cases, the relative position in respect of the row drum 17 is chosen so that the groups of recesses **35*a*, 35*b*, etc. and 36 surround and grasp cigarettes 10 by means of the respective retaining recesses 31 in the the position adjacent to the periphery of the row drum 17, and these cigarettes are transported in this region in the retaining recesses 23 of the row drum 17. Consequently, in these regions the cigarettes 10 are momentarily surrounded by two retaining recesses 23 and 31 respectively immediately adjacent one another. During this stage, the transfer from the row drum 17 to the transfer drum 19, 20, 21 takes place, specifically, as is evident from FIG. 3**, in succession during the continuous further movement of the participating devices.

Because of the limited number of retaining recesses 31 in a group of recesses **35*a*, 35*b*, etc. and 36, only cigarettes 10 corresponding to the number of a cigarette row 12, 13, 14 are received from the row drum 17 in the transfer regions. The outer regions of the transfer drums 19, 20, 21 are designed between the groups of recesses 35***a*, 35*b* etc. and 36, namely set back inwards, so that there is no contact here with the cigarettes 10 of the row drum 17.

Furthermore, the relative position of the transfer drums 19, 20,21 is chosen so that approximately simultaneously a cigarette row 12, and a row 14 are received from the row drum 17 by the (larger) transfer drums 19 and 21 and are delivered to the group drum 18 (in the region of another group of recesses). After the cigarette row 14 lying last on the radially outer side in the pocket 22*a*, 22*b* etc. has been received, a corresponding gap in the sequence of cigarettes 10 arises on the periphery of the row drum 17. Whilst maintaining the required predetermined distances, cigarettes 10 are conveyed further corresponding to the cigarette rows 13 and 12 received subsequently in the conveying direction of the row drum 17. A number of seven cigarettes 10 retained on the periphery of the row drum 17 corresponds to the cigarette row 12 last removed and lying on the inside in the pocket.

Figure 3:
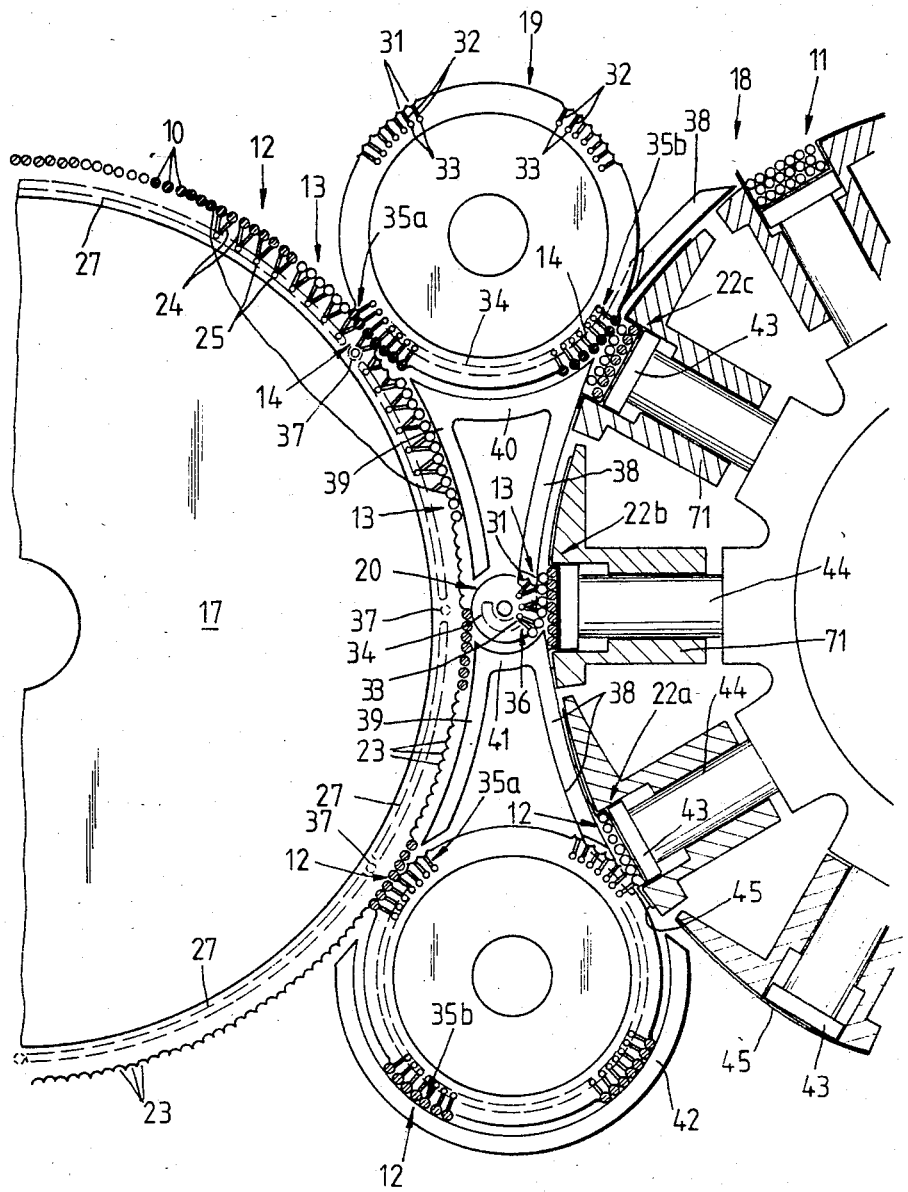
FIG. 3 shows, in a side view or in a vertical section, a representation of the apparatus on a larger scale in the region of the group formation.

As is evident from FIG. 3, these devices are mutually coordinated with one another in such a way that the cigarette rows 12, 13, 14 are transferred to the associated pockets 22*a*, 22*b*, 22*c*, etc. slightly staggered in time: the radially inner cigarette row 12 is deposited first, whilst the cigarette rows 13, 14 are transferred to the associated pocket 22*a*, 22*b* etc. with a time lag. The transfer drums 19, 20, 21 are, for this purpose, connected operatively (toothed gearing 69) to the row drum 17.

The orderly and fault-free transfer of the cigarettes 10 between the row drum 17 and the transfer drums 19, 20, 21 takes place with the aid of suction air. For this purpose, the annular groove 27, on the one hand and 34, on the other hand, are sub-divided into portions. A vent bore 37 is provided between each of the annular-groove portions of the row drum 17. This ensures that momentarily, namely during the stage when a cigarette 10 is received by the transfer drums 19, 20, 21, the retaining force in the region of the retaining recesses 23 of the row drum 17 is eliminated. When suction force acts simultaneously in the retaining recesses 31 of the transfer drums 19, 20, 21, cigarettes 10 are thus received in succession by these.

During the transfer of cigarette rows 12, 13, 14 to the group drum 18, mechanical devices are used for assistance. The annular grooves 34 are not effective in the transfer region because of their appropriate dimensions. Here, the cigarettes 10 are grasped by a fixed outer guide 38 in the form of a circular arc and are pressed into the pockets 22*a*, 22*b*, 22*c* etc. and retained in these. The rib-like outer guide 38 penetrates into the grooves 30 formed in the transfer drums 19, 20, 21 in the way described (FIGS. 4 and 5).

The outer guide 38 also extends outside the region of the cigarette transfer for additionally retaining and securing the cigarettes 10 in their positions. A corresponding outer guide 39 is also arranged so as to lie opposite in the region of the row drum 17, so that it is guaranteed here that the cigarettes 10 will be additionally secured in the retaining recesses 23. Likewise, outer guides 40, 41 and 42 are assigned respectively to the transfer drums 19, 20, 21 in the regions in which cigarettes 10 are conveyed.

The group drum 18 is also designed in a special way. The pockets 22*a*, 22*b*, 22*c*, etc. thereof are made with a variable size, namely a variable depth in the radial direction. The radially inner limitation of the pockets 22*a*, 22*b*, etc. is formed by a bottom piece 43 which is fastened, here, to a radially directed rod 44. Side faces of the pockets 22*a*, 22*b*, etc. are formed by a special shaped pocket piece 71. This is provided with a recessed portion for receiving the bottom piece 43 and with bearing faces extending in the peripheral direction for a pack blank 45.

Figure 9:
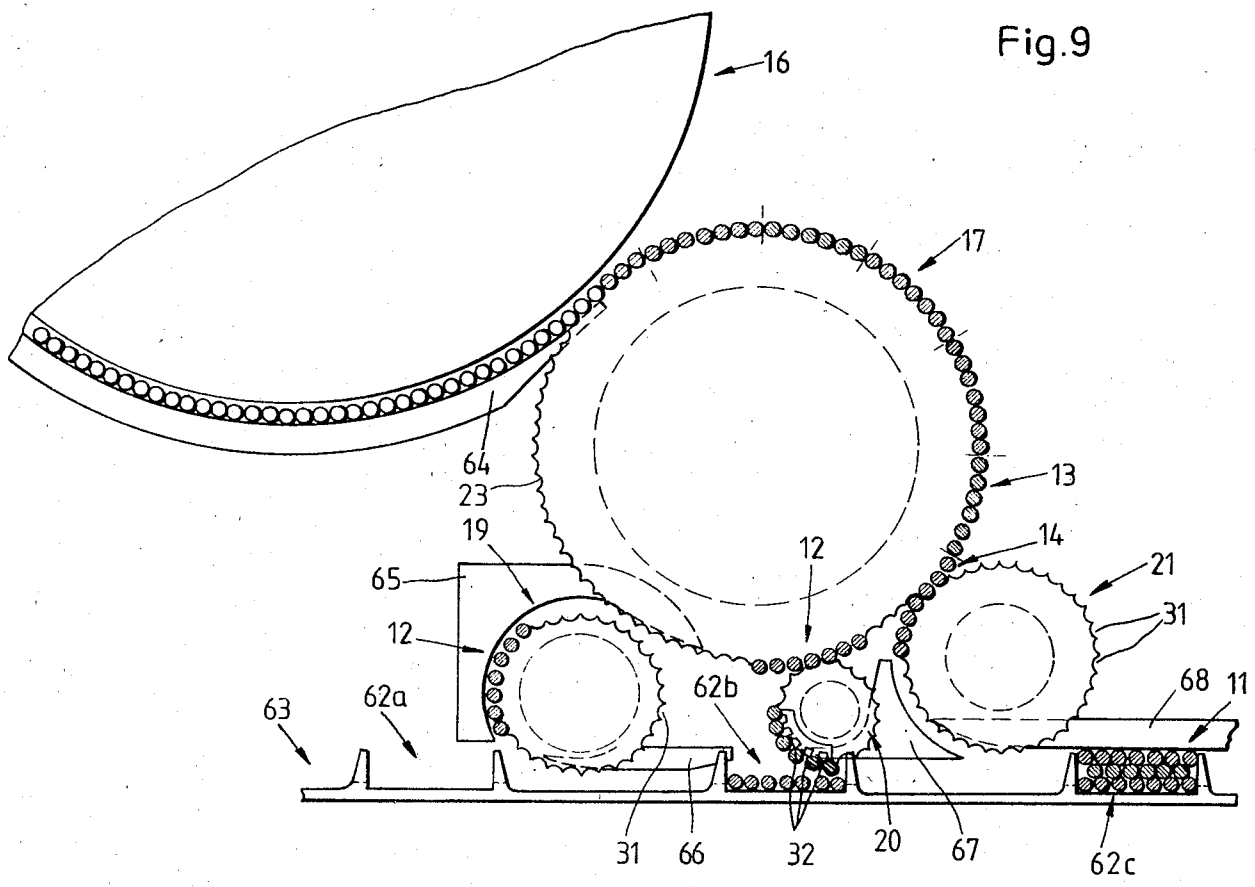
FIG. 9 shows, in a diagrammatic side view, details of another embodiment of the apparatus.

The pockets 22*a*, 22*b*, etc. and the entire group drum 18 are preferably designed with the features of the turrets in Patent Application P 29 49 252.2 (especially the tin-foil turret 33 in FIG. 9). This means that the bottom piece 43 and the shaped pocket piece 71 are movable relative to one another in the radial direction, so as thereby to vary the effective depth of the pockets 22*a*, 22*b*, etc. In the present example, the shaped pocket piece 71 is displaceable on the rod 44, with the bottom piece 43 being stationary.

Because of the given relative position, a first position of the shaped pocket piece 71 directed radially outwards leads to a relatively shallow pocket 22*a* which, in this initial position, is suitable for receiving a first inner cigarette row 12. To receive the next cigarette rows 13 and 14, the shaped pocket piece 71 is moved further outwards in steps (pockets 22*b* and 22*c*), so that finally the pockets acquire a depth or radial dimension which is suitable for receiving a complete cigarette group 11, with the result that the latter is essentially flush with the outer periphery of the group drum 18.

In the present exemplary embodiment, it is envisaged, in this respect, that the pack blank 45 together with the cigarettes 10 should be introduced into the pockets 22*a*, 22*b*, etc. so that the cigarette group 11 formed, after being completed, is partially enveloped by the pack blank 45, especially a blank made of tin foil or the like.

Furthermore, the tranfer of cigarettes 10 from the cigarette magazine 15 to the first conveyor (collecting drum 16) is achieved in a special way.

In the present case, the cigarette magazine 15 is provided with an unusually large number of cigarette shafts 46, each for accommodating a series of individual cigarettes 10 arranged above one another. The lower ends of the cigarette shafts 46 form an arc, namely approximating the circular shape of the collecting drum 16 located underneath the cigarette magazine 15. The cigarette shafts 46 end at a bearing plate 47 curved in a correspondingly arcuate manner. Consequently, the particular bottom cigarette 10 of each cigarette shaft 46 rests on this bearing plate.

Figure 6:
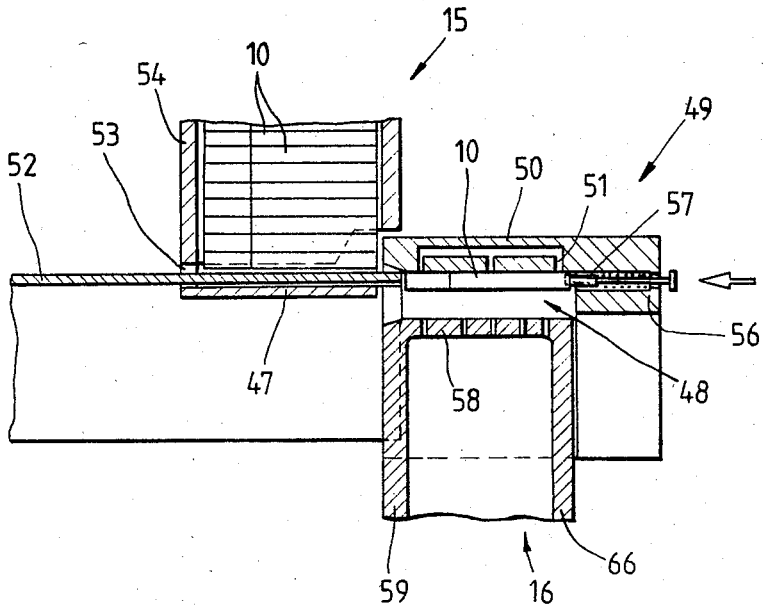
FIG. 6 shows, in a vertical or radial section, a detail in the region of the transfer of cigarettes from a magazine to a collecting drum.
Figure 7:
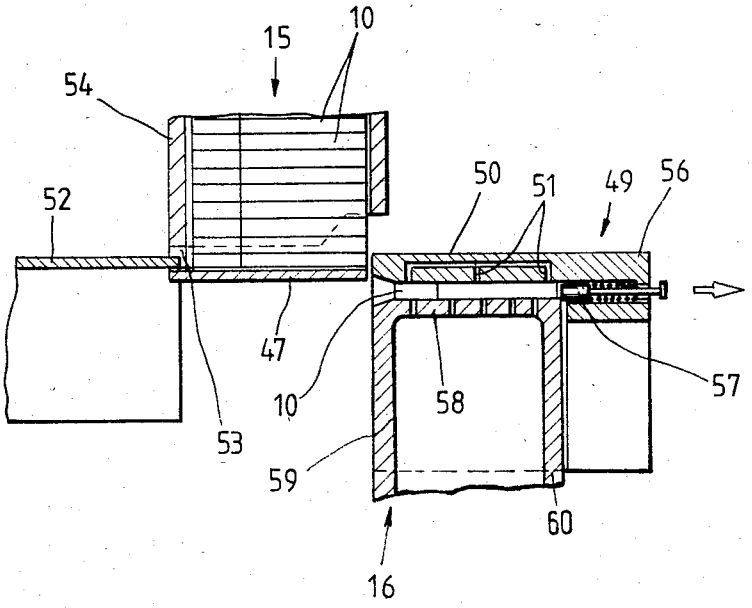
FIG. 7 shows the detail according to FIG. 6, with changed positions of parts of the apparatus.
Figure 8:
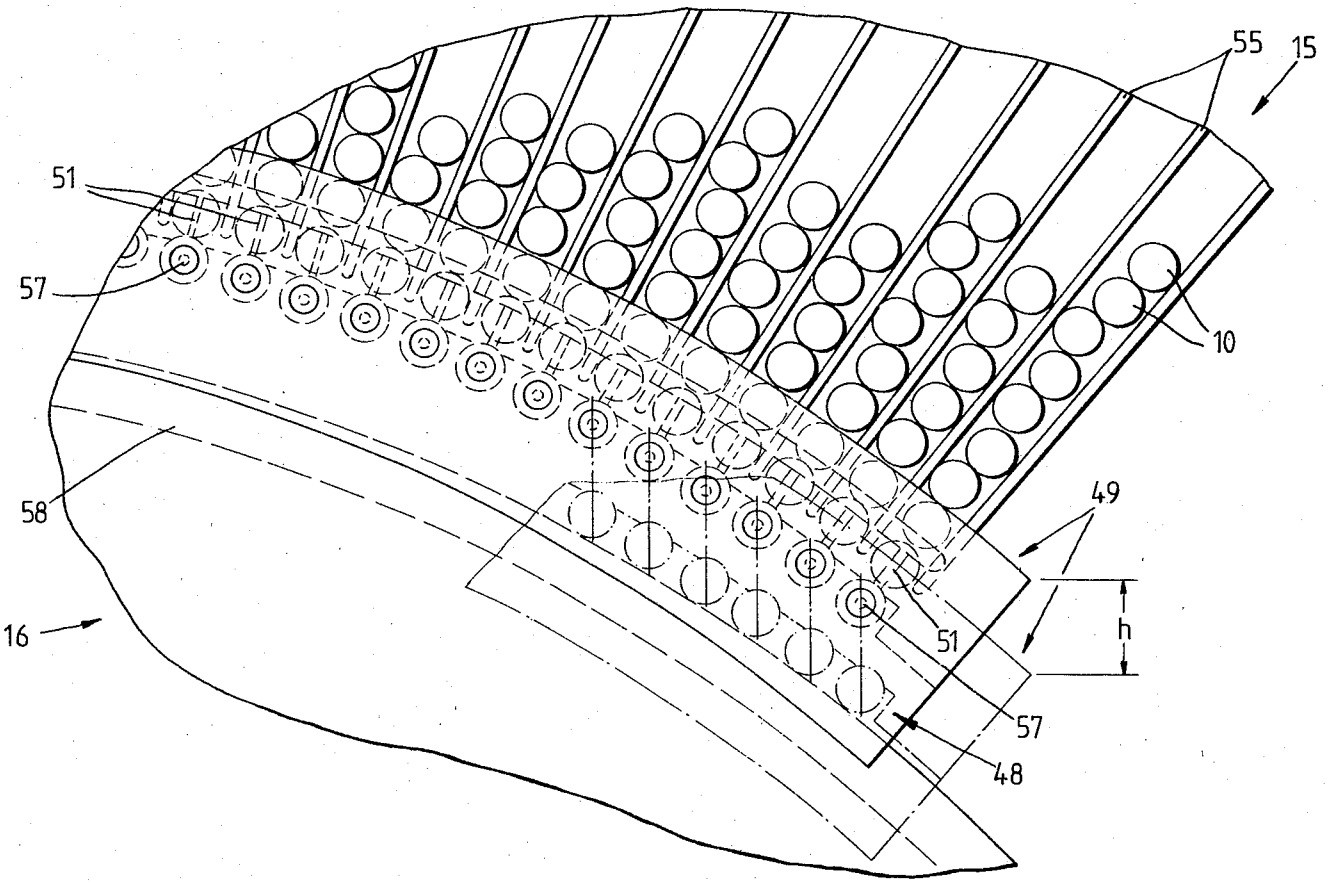
FIG. 8 shows, as a cut-out, a detail in the region illustrated in FIGS. 6 and 7, in a view offset by 90°.

As is evident from FIGS. 6 and 7, the collecting drum 16 is arranged underneath the cigarette magazine 15 and offset laterally thereto. The particular bottom cigarettes 10 in the cigarette shafts 46 constitute a batch 48 which is pushed out of the cigarette magazine 15 and transferred to the collecting drum 16 in one work cycle. For this purpose, there is an intermediate conveyor in the shape of a transfer segment 49 taking the form of a circular arc. This consists of a curved carrier plate 50, on the underside of which the cigarettes 10 belonging to the batch 48 are retained periodically by means of suction bores 51. The cigarettes 10 of the batch 48 are transferred from the cigarette magazine 15 to this transfer segment 49 by means of a likewise arcuate plate-shaped pusher 52 which passes through a lower arcuate gap 53 in a facing rear wall 54 of the cigarette magazine 15 and which, by reciprocating movement, pushes a batch 48 of cigarettes at a time out of the cigarette shafts 46. For this purpose, shaft walls 55 formed between these cigarette shafts 46 end at an appropriate distance above the bearing plate 47.

The transfer segment 49 is provided with a stop wall 56 on the side located opposite the open receiving side, that is to say facing the cigarette magazine 15. The cigarettes 10 transferred by the pusher 52 rest against this stop wall with their ends. At the same time, this stop wall 56 serves for receiving spring-loaded tappets 57. These are part, namely a sensing member, of a cigarette testing device for testing the presence and a sufficient tobacco filling of the cigarettes 10 by sensing their heads.

The transfer segment 49 is movable up and down, namely from the upper receiving position according to FIG. 6 into the lower delivery position according to FIG. 7. In the latter position, the cigarettes 10 of the batch 48, which are retained on the carrier plate 50, are transferred to the collecting drum 16, namely by being deposited on a (cylindrical and smooth-walled) drum casing 58. At the same time, the tappets 57 are drawn back from the testing position (resting against the ends of the cigarettes 10). The suction air in the region of the suction bores 51 is turned off after the cigarettes 10 come to rest against the drum casing 58.

In the present exemplary embodiment, the collecting drum 16 is designed, as a whole, as a hollow body subjected to a partial vacuum. Lateral drum discs 59 and 60 are connected fixedly to the drum casing 58. Following the cigarette magazine 15 or the transfer segment 49, a fixed outer guide 61 guaranteeing that the cigarettes 10 will be retained on the drum casing 58, is assigned to the collecting drum 16. Dimensions are chosen so that the batch 48 deposited on the collecting drum 16 is initially at a distance from the batch 48 previously deposited. As result of the speed ratios, this distance is eliminated during the further transport of the cigarettes 10 by the collecting drum 16, so that finally, namely during transfer to the row drum 17, a close sequence of cigarettes 10 on the drum casing 58 is guaranteed. The smooth-surfaced drum casing 58 is provided with a plurality of suction bores 70 which are subjected to a vacuum via the interior of the collecting drum 16.

An alternative design of the apparatus for forming the cigarette groups 11 is illustrated in FIG. 9.

Here too, the cigarettes 10 are supplied in close sequence by a row drum 17. Here again, transfer drums 19, 20, 21 serve for forming the cigarette rows 12, 13, 14. However, the cigarette rows 12, 13, 14 are not deposited in the pockets of a revolving turret or a drum, but in pockets 62*a*, 62*b*, 62*c*, etc. of a linear conveyor, namely a pocket conveyor 63. The cigarettes 10 of a cigarette row 12, 13, 14 are received from the row drum 17 by the transfer drums 19, 20, 21 in the same or in an appropriate way and are deposited in the pockets 62*a*, 62*b*, 62*c*. In contrast to the exemplary embodiment described previously, however, here the transfer drums 19, 20, 21 are provided with retaining recesses 31 all round. In this case, receiving and delivering the cigarettes 10 are determined and controlled because only those retaining recesses 31 can be subjected to suction which are intended to serve for receiving the six or seven cigarettes 10. The remaining retaining recesses are not subjected to suction air, so that when the fixing of the cigarettes 10 in the retaining recesses 23 of the row drum 17 is maintained these cigarettes are conveyed further.

Outer guides 64, 65, 66, 67, and 68 are also provided here in a similar way to the exemplary embodiment described, specifically, on the one hand, for the additional retention of cigarettes 10 in retaining recesses 23 and 31 respectively and, on the other hand, for securing the transfer of cigarettes 10 from one conveyor to the other. In the latter case, part regions of the outer guides penetrate, in a way described, into encircling grooves in the respective conveyors.

We claim:

1. Apparatus for the extraction of bar-shaped articles, particularly cigarettes, from out of a cigarette magazine with cigarette shafts lying next to one another, said cigarettes being supplied by said magazine for extraction in upright individual rows and for delivery of the extracted cigarettes onto an endless conveyor (16) laterally offset and underneath said cigarette magazine, said apparatus including a pusher (52) for pushing a batch (48) of cigarette shafts laterally out of the lower area of the magazine housing the cigarette shafts, and a delivery unit for transport of the cigarette batches (48), respectively, onto said endless conveyor, the improvement wherein:

said endless conveyor directly underlies said delivery unit, and said pusher (52) projects into said delivery unit to cause the batch (48) of cigarette shafts to move into a position above said endless conveyor (16), and means for causing said delivery unit to take up said batch of cigarettes and deposit them onto said endless conveyor (16).

2. The apparatus according to claim 1, wherein said endless conveyor is a collecting drum (16), said delivery unit is in the form of a circular arc transfer segment (49) matching the shape of said collecting drum (16), and said transfer segment has an arcuate carrier plate (50) with suction bores (51) for receiving the cigarette batch (48) on its underside.

3. The apparatus according to claim 2, wherein said transfer segment (49) has, on the side located opposite the cigarette magazine (15), a stop wall (56), and spring-loaded tappets (57) mounted within said stop wall (56) of a number corresponding to and being axially aligned with the individual cigarette shafts of said batch (48) for checking the cigarettes by physically sensing their heads.

4. The apparatus according to claim 2, wherein said collecting drum (16) has a drum casing (58) constructed with a smooth outer peripheral surface, and said surface is provided with a plurality of suction bores arranged at a suitable distance from one another.

5. The apparatus according to claim 1, further comprising a row drum (17) for receiving cigarettes (10) from the endless conveyor collecting drum (16), and a group drum (18) operatively positioned in juxtaposition to said row drum (17) to effect formation of cigarette groups consisting of multiple rows (12, 13, 14) of cigarettes (10).

* * * * *